US007066408B2

(12) United States Patent
Sugimoto et al.

(10) Patent No.: US 7,066,408 B2
(45) Date of Patent: Jun. 27, 2006

(54) FUEL INJECTION VALVE

(75) Inventors: Tomojiro Sugimoto, Susono (JP); Keiso Takeda, Mishima (JP); Shigeo Furuno, Fuji (JP); Kimitaka Saito, Nagoya (JP); Yasuhide Tani, Nagoya (JP); Atsuya Okamoto, Okazaki (JP); Takehiko Kato, Nukata-gun (JP); Tatsushi Nakashima, Anjyo (JP)

(73) Assignees: Toyota Jidosha Kabushiki Kaisha, Toyota (JP); Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/826,355

(22) Filed: Apr. 19, 2004

(65) Prior Publication Data

US 2004/0217204 A1 Nov. 4, 2004

(30) Foreign Application Priority Data

Apr. 25, 2003 (JP) ..... 2003-122104
Nov. 26, 2003 (JP) ..... 2003-395675

(51) Int. Cl.
*B05B 1/26* (2006.01)
*F02M 61/00* (2006.01)

(52) U.S. Cl. ..... 239/461; 239/463; 239/596; 239/533.12; 239/533.14

(58) Field of Classification Search ..... 239/533.12, 239/596, 597, 598, 599, 601, 533.2, 533.11, 239/555.1, 555.5, 533.14, 552, 461, 533.1, 239/533.5

See application file for complete search history.

(56) References Cited

U.S. PATENT DOCUMENTS 5,244,154 A * 9/1993 Buchholz et al. ..... 239/590.3
5,899,390 A * 5/1999 Arndt et al. ..... 239/553
5,924,634 A * 7/1999 Arndt et al. ..... 239/553
5,979,802 A * 11/1999 Hasegawa ..... 239/533.12

(Continued)

FOREIGN PATENT DOCUMENTS

DE 196 29 755 C2 12/1998

(Continued)

*Primary Examiner*—David A. Scherbel
*Assistant Examiner*—Seth Barney
(74) *Attorney, Agent, or Firm*—Oliff & Berridge, PLC

(57) ABSTRACT

There is provided a fuel injection valve in which nozzle holes are formed on a metering plate and fuel flowing on a face of the metering plate on the upstream side is injected outside of a face of the metering plate on the downstream side through the nozzle holes. The fuel injection valve includes a vortex flow generator means for changing a flow of fuel passing in each nozzle hole into a vortex flow, wherein the vortex flow generator means is provided on the upstream side of the metering plate. The vortex flow means is a vortex flow generator groove provided on an upper face of the metering plate and connected with a wall face of an entrance of the nozzle hole, and a main stream of fuel flowing in the groove is directed to a position shifted from the center of the nozzle hole. Alternatively, the vortex flow means is a protrusion formed on an upper face of the metering plate. A flow of fuel is changed into a vortex flow in the nozzle hole and injected from the nozzle hole. Therefore, fuel can be excellently atomized and diffused as a megaphone-shape without being formed into a liquid column spray.

3 Claims, 10 Drawing Sheets

U.S. PATENT DOCUMENTS 5,984,211 A * 11/1999 Sugimoto et al. ..... 239/596
6,089,473 A * 7/2000 Keim ..... 239/533.12
6,161,782 A * 12/2000 Heinbuck et al. ..... 239/585.1
6,170,763 B1 * 1/2001 Fuchs et al. ..... 239/533.12
6,273,349 B1 * 8/2001 Fischbach et al. ..... 239/585.1
6,513,724 B1 * 2/2003 Joseph et al. ..... 239/5
6,695,229 B1 * 2/2004 Heinbuch et al. ..... 239/494
6,708,904 B1 * 3/2004 Itatsu ..... 239/533.12
6,854,670 B1 * 2/2005 Sumisha et al. ..... 239/543

FOREIGN PATENT DOCUMENTS

JP U 60-15968 2/1985
JP A 8-296532 11/1996
JP A 9-32695 2/1997

* cited by examiner

FUEL INJECTION VALVE

BACKGROUND OF THE INVENTION

1. Field of the Invention

The present invention relates to a fuel injection valve.

2. Description of the Related Art

In order to inject fuel into a cylinder of an internal combustion engine, a fuel injection valve is used. The following type of fuel injection valve is provided. As shown in FIG. 12, the metering plate 3 is arranged in the front of the forward end portion of the needle 2 which is slidably provided in the valve body 1. Via the fuel passage 4 formed between the valve body 1 and the needle 2, fuel flowing between the lower face of the needle 2 and the upper face of the metering plate 3 is injected from the nozzle hole 5 formed on the metering plate 3. FIG. 13 is a top view of the metering plate 3, on which a plurality of nozzle holes 5 are equally formed. FIG. 14A is a top view showing a flow of fuel around one nozzle hole 5. FIG. 14B is a sectional side view of the flow of fuel around the nozzle hole 5. In this case, fuel is cylindrically injected, and what is called a liquid column spray is generated.

As disclosed in the official gazette of Japanese Unexamined Patent Publication No. 9-32695, there is provided a fuel injection valve in which the nozzle hole 5 is obliquely formed so as to suppress the generation of a liquid column spray.

However, the regulations regarding exhaust gases have been further strengthened recently. Accordingly, there is a possibility that the above fuel injection valve of the prior art will be insufficient to fulfil these regulations.

Accordingly, there is a demand for a fuel injection valve capable of atomizing excellently fuel.

SUMMARY OF THE INVENTION

It is a task of the present invention to provide a fuel injection valve capable of atomizing fuel excellently.

According to the present invention, there is provided a fuel injection valve in which a nozzle hole is formed on a metering plate and fuel flowing on a face on the upstream side of the metering plate is injected outside of a face on the downstream side of the metering plate, the fuel injection valve comprising: a vortex flow generator means for making a flow of fuel passing in the nozzle hole formed into a vortex flow, wherein the vortex flow generator means is provided on the upstream side of the metering plate.

According to an embodiment of the present invention, the vortex flow generator means is a vortex flow generator groove provided on a face on the upstream side of the metering plate so that the vortex flow generator groove can be connected to a wall face of the inlet of the nozzle hole, and a main stream of fuel flowing in the groove is directed to a position deviating from a center of the nozzle hole.

It is preferable that the following relations are established, $$L \times 1/5 < F < L \times 2/3$$

$$D \times 1/5 < N < D \times 3$$

$$D \times 1/5 < H < D \times 2/3$$

$$D \times 1/5 < B < D \times 1/2,$$

where F is depth of the vortex flow generator groove, N is length, H is width, and B is an offset of the center line in the longitudinal direction from the center of the nozzle hole.

It is preferable that the vortex flow generator groove is formed so that a flow of fuel from the outer circumferential side of the metering plate can be guided by the groove.

It is preferable that a plurality of vortex flow generators are provided for one nozzle hole.

It is preferable that depth of the vortex flow generator groove is formed to be constant, increased or decreased toward the nozzle hole.

It is preferable that the shape of the vortex flow generator groove is a rectangle, a semi-ellipse, a triangle having one vertex on the nozzle hole side, a triangle having one vertex on the end portion side or a comma-shape curved in the direction of revolution of fuel.

It is preferable that the vortex flow generator groove has a function of giving a pre-rotation to fuel so that fuel can be rotated when it flows into the nozzle hole.

According to an embodiment of the present invention, the vortex flow generator means is a guide protrusion formed on an upper face of the metering plate.

According to the present invention, there is provided a fuel injection valve in which a nozzle hole is formed on a metering plate, fuel flowing on a face on the upstream side of the metering plate is injected outside of a face on the downstream side of the metering plate and a needle having a forward end face opposed to the metering plate is arranged on the upstream side of the metering plate, the fuel injection valve comprising: a vortex flow generator means for making a flow of fuel passing in the nozzle hole form into a vortex flow, wherein the vortex flow generator means is guide groove formed on the forward end face of the needle.

The present invention may be more fully understood from the description of preferred embodiments of the invention set forth below, together with the accompanying drawings.

DESCRIPTION OF THE PREFERRED EMBODIMENTS

Referring to the accompanying drawings, each embodiment of the present invention will be explained below.

Figure 1:
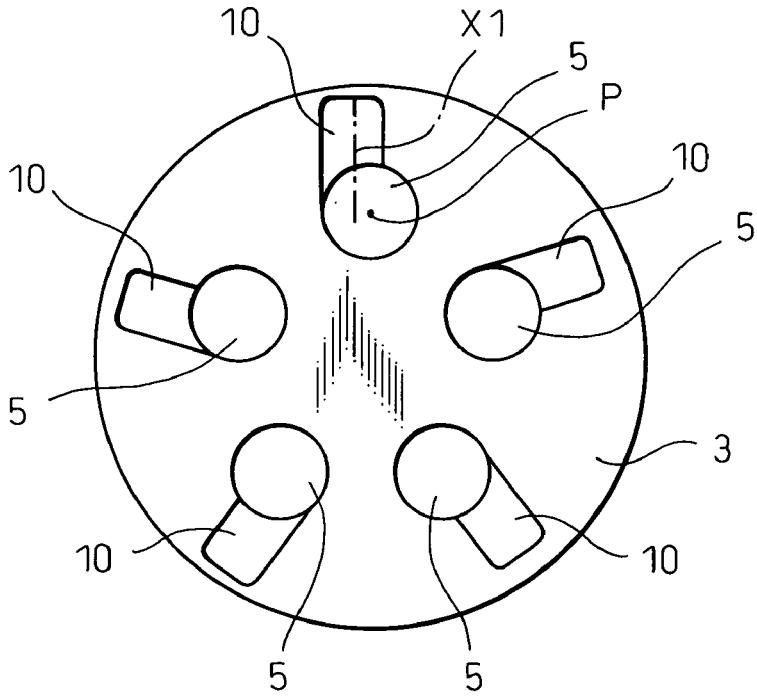
FIG. 1 is a top view of the plate of the first embodiment of the present invention.

First of all, the first embodiment is explained as follows. FIG. 1 is a top view of the metering plate 3 provided in the first embodiment, that is, FIG. 1 is a view of the metering plate 3, wherein the view is taken from the upstream side of a flow of fuel. A plurality of nozzle holes 5 (in this case, five nozzle holes) are provided on the metering plate 3. On an upper face of the metering plate 3, the vortex flow generator grooves 10 are provided.

As shown in the drawing, each vortex flow generator groove 10 is formed as follows. Center line X of the vortex flow generator groove 10 in the longitudinal direction is substantially directed from the circumferential side of the metering plate 3 to the center. However, center line X of the vortex flow generator groove 10 in the longitudinal direction is shifted from center P of the nozzle hole 5 so that center line X cannot pass through center P of the nozzle hole 5. One wall face of the vortex flow generator groove 10 in the longitudinal direction is tangentially connected to the wall face of the nozzle hole 5. In this connection, the outer circumferential circle of the metering plate 3 represents an effective region of the metering plate 3, that is, the outer circumferential circle of the metering plate 3 represents a region in which fuel flows on the upstream side surface.

Figure 2A:
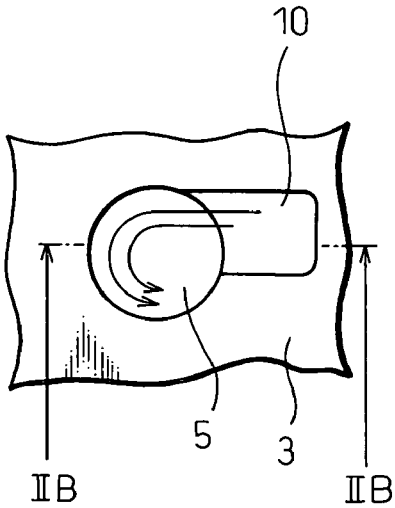
FIG. 2A is a top view of the flow of fuel in the neighborhood of a nozzle hole, wherein the view is taken from an upper portion of the nozzle hole.
Figure 2B:
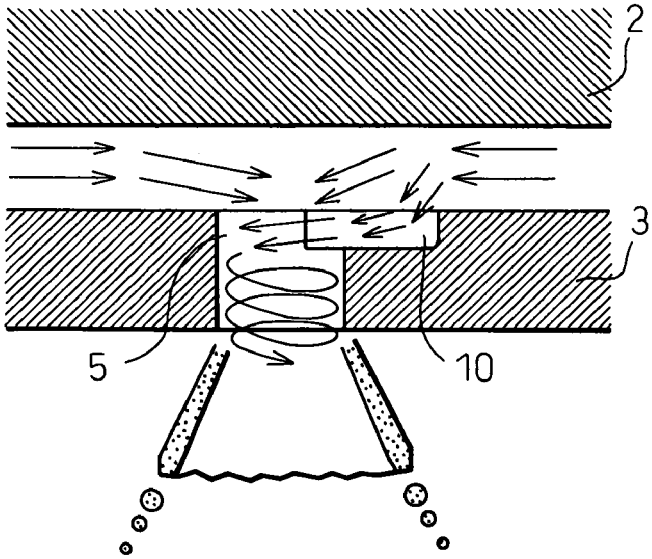
FIG. 2B is a sectional view taken on line IIB—IIB in FIG. 2A.

FIG. 2A is a top view showing a flow of fuel from the vortex flow generator groove 10 into one nozzle hole 5. The flow of fuel passing in the vortex flow generator groove 10 revolves along the wall of the nozzle hole 5, and a vortex flow is generated. FIG. 2B is a sectional view taken on line IIB—IIB in FIG. 2A. The flow of fuel proceeds inside the nozzle hole being spirally revolved. Then the flow of fuel is diffused like a megaphone-shape and injected from the outlet 11 of the nozzle hole 5 and excellently atomized. Therefore, a liquid column spray, which is usually formed in the fuel injection valve of the prior art, is not formed.

Next, explanations are made into the dimensions of each portion of the vortex flow generator 10 so as to generate an excellent vortex flow. First, referring to FIG. 3A, the dimensions are defined as follows.

Thickness of the metering plate 3: L

Diameter of the nozzle hole 5: D

Depth of the vortex flow generator groove 10: F

Further, referring to FIG. 3B, the dimensions are defined as follows.

Passage width of the vortex flow generator groove 10: H

Passage length of the vortex flow generator groove 10: N (To be specific, the passage length of the vortex flow generator groove 10 is a distance from the point of intersection, at which a line passing through the center of the vortex flow generator groove 10 in the width direction crosses a line passing through the center of the nozzle hole 5 perpendicular to this line, to the end portion of the vortex flow generator groove 10.)

Figure 4A:
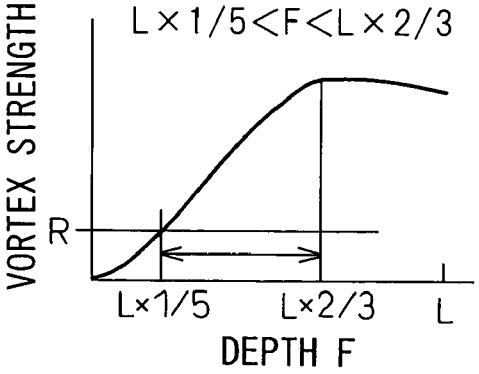
FIG. 4A is a graph showing an appropriate value of the depth of a vortex flow generator groove.

Offset distance from the center of the nozzle hole 5 to the center of the vortex flow generator groove 10 in the width direction: B In order to obtain a predetermined vortex strength according to the above definition, depth F of the vortex flow generator groove 10 must satisfy the following inequality with respect to thickness L of the metering plate 3 as shown in FIG. 4A.

$$L\times 1/3<F<L\times 2/3$$

Figure 4B:
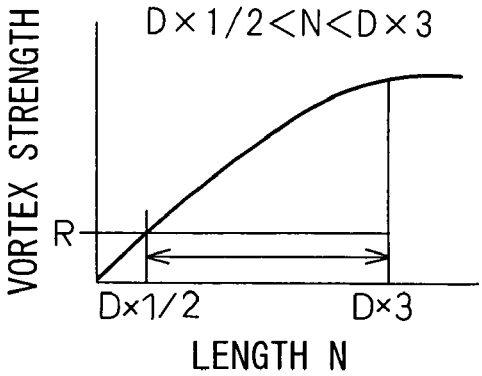
FIG. 4B is a graph showing an appropriate value of the length of the vortex flow generator groove.

As shown in FIG. 4B, passage length N of the vortex flow generator groove 10 satisfies the following inequality with respect to diameter D of the nozzle hole 5.

$$D\times 1/2<N<D\times 3$$

Figure 4C:
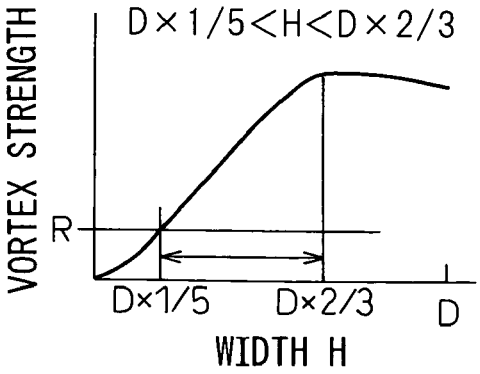
FIG. 4C is a graph showing an appropriate value of the width of the vortex flow generator groove.

As shown in FIG. 4C, passage width H of the vortex flow generator groove 10 satisfies the following inequality with respect to diameter D of the nozzle hole 5.

$$D\times 1/3<D<L\times 2/3$$

Figure 4D:
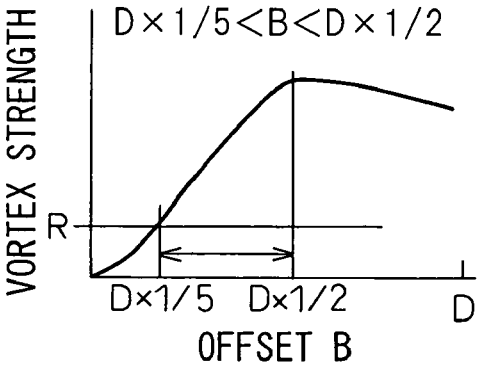
FIG. 4D is a graph showing an appropriate value of the offset of the vortex flow generator groove.

As shown in FIG. 4D, passage offset B of the vortex flow generator groove 10 satisfies the following inequality with respect to diameter D of the nozzle hole 5.

$$D\times 1/3<D<L\times 1/2$$

Next, referring to FIGS. 5A to 5C, explanations will be made into variations in which the depth of the vortex flow generator groove 10 is changed.

Figure 3A:
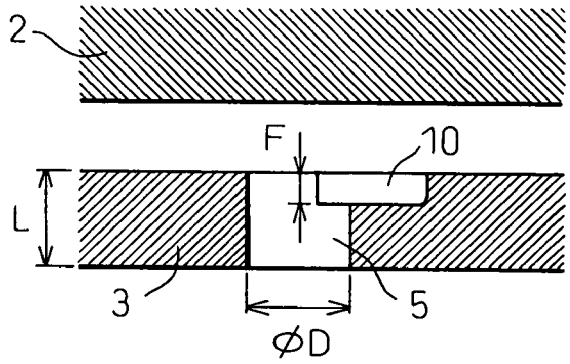
FIG. 3A is a view showing a dimensional position of each portion to determine the item value of the nozzle hole in the case where the view is taken from an upper portion.
Figure 3B:
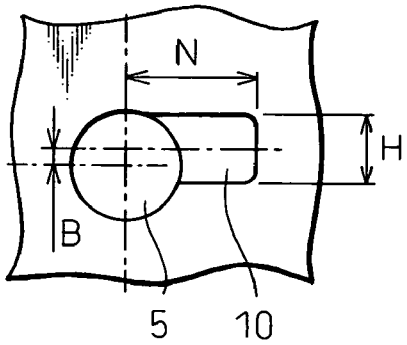
FIG. 3B is a view showing a dimensional position of each portion to determine the item value of the nozzle hole in the case where the view is taken on a cross section.
Figure 5A:
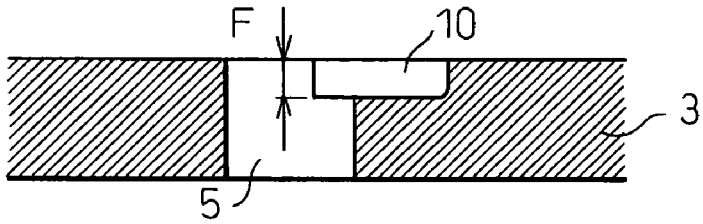
FIG. 5A is a view showing a vortex flow generator groove, the depth of which is constant.
Figure 5B:
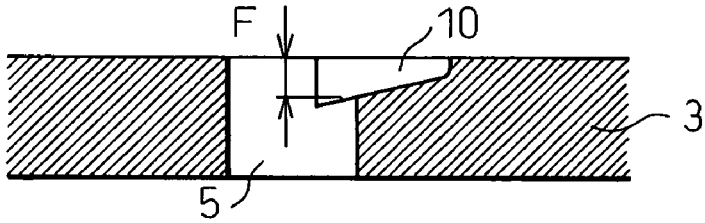
FIG. 5B is a view showing a vortex flow generator groove, the depth of which is gradually increased when it comes close to a nozzle hole.
Figure 5C:
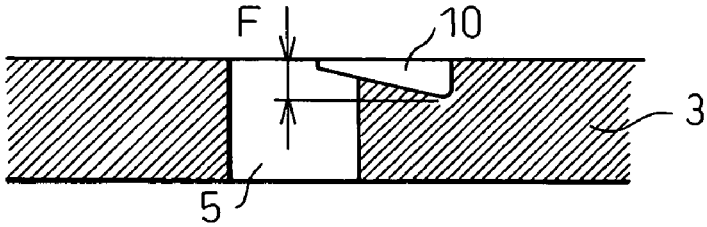
FIG. 5C is a view showing a vortex flow generator groove, the depth of which is gradually decreased when it comes close to a nozzle hole.

In FIG. 5A, the standard vortex flow generator groove 10 is shown, that is, as shown in FIG. 3A, the depth of the vortex flow generator groove 10 is constant from the end portion to the nozzle 5. In FIG. 5B, the depth of the vortex flow generator groove 10 increases when it comes from the end portion to the nozzle hole 5. In FIG. 5C, the depth of the vortex flow generator groove 10 decreases when it comes from the end portion to the nozzle hole 5. In the structure shown in FIG. 5B, the fuel injection force is high, however, the vortex strength is low. In the structure shown in FIG. 5C, the fuel injection force is low, however, the vortex strength is high. In the structure shown in FIG. 5A, the fuel injection force and vortex strength are, respectively, medium.

Next, referring to FIGS. 6A to 6E, explanations will be made into variations in which the shape of the vortex flow generator groove 10 (the shape of a top face of the vortex flow generator groove 10) is changed.

Figure 6A:
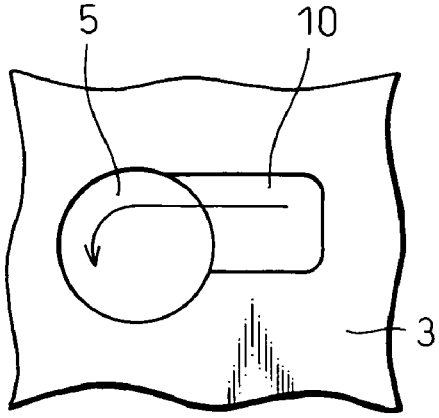
FIG. 6A is a view showing a vortex flow generator groove, the upper face of which is formed into a rectangle.
Figure 6B:
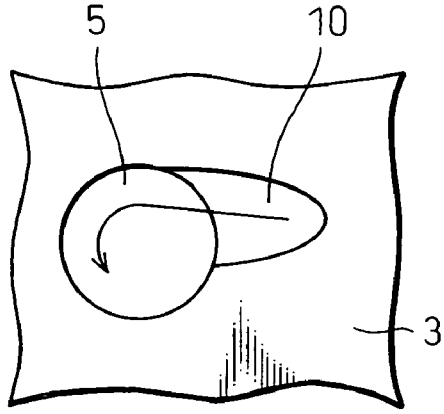
FIG. 6B is a view showing a vortex flow generator groove, the upper face of which is formed into a semi-ellipse gradually extending onto the nozzle hole side.
Figure 6C:
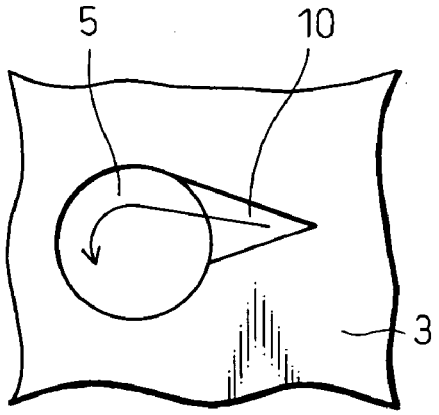
FIG. 6C is a view showing a vortex flow generator groove, the upper face of which is formed into a triangle linearly extending onto the nozzle hole side.
Figure 6D:
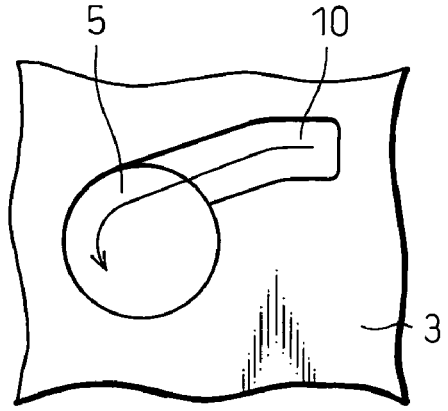
FIG. 6D is a view showing a vortex flow generator groove, the upper face of which is formed into a comma-shape curved according to a vortex flow.
Figure 6E:
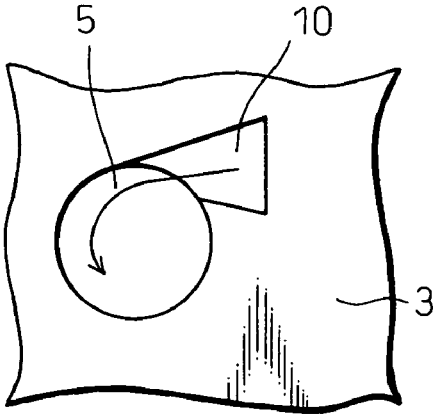
FIG. 6E is a view showing a vortex flow generator groove, the upper face of which is formed into a triangle linearly reduced on the nozzle hole side.

FIG. 6A shows the standard structure, that is, FIG. 6A shows a case in which the top view shape of the vortex flow generator groove 10 is a rectangle. FIG. 6B shows a case in which the top view shape of the vortex flow generator groove 10 is a semi-ellipse which is curved from the end portion side to the nozzle hole side. FIG. 6C shows a case in which the top view shape of the vortex flow generator groove 10 is a triangle having one vertical angle at the end portion side which is linearly extended from the end portion side to the nozzle hole side. FIG. 6D shows a case in which the top view shape of the vortex flow generator groove 10 is a comma-shape, at the middle portion of which the comma-shape is curved in the same direction as the direction of revolution. FIG. 6E shows a case in which the top view shape of the vortex flow generator groove 10 is a triangle, the nozzle hole 5 side of which is reduced. In this connection, in all the vortex flow generator grooves 10 shown in FIGS. 6A to 6E, the peripheral portion of the metering plate 3 is located on the right in the drawing, and fuel flows in the direction shown by the arrow.

Next, referring to FIGS. 7A to 7D, explanations will be made into variations in which the number of the passages of the vortex flow generator groove 10 is changed.

Figure 7A:
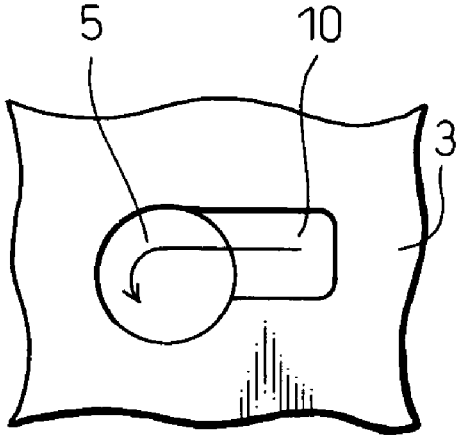
FIG. 7A is a view showing a nozzle hole provided with one vortex flow generator groove.
Figure 7B:
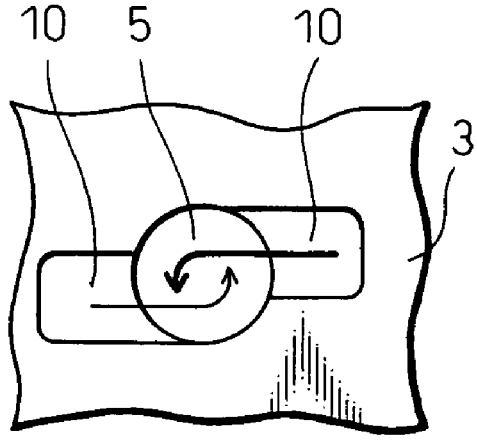
FIG. 7B is a view showing a nozzle hole provided with two vortex flow generator grooves.
Figure 7C:
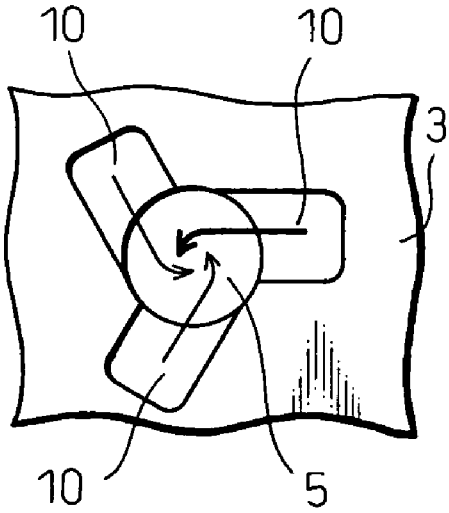
FIG. 7C is a view showing a nozzle hole provided with three vortex flow generator grooves.
Figure 7D:
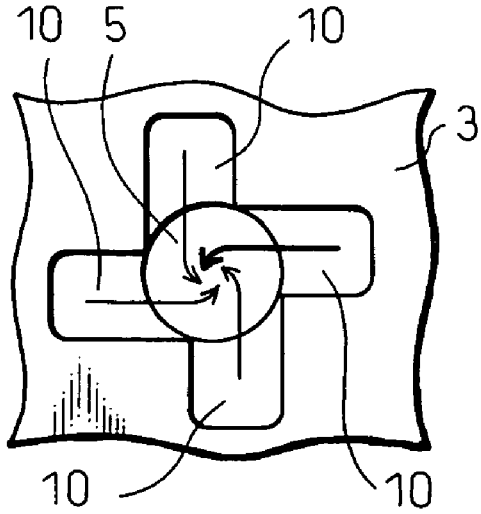
FIG. 7D is a view showing a nozzle hole provided with four vortex flow generator grooves.

FIG. 7A shows the standard passage of the vortex flow generator groove 10, that is, FIG. 7A shows a case in which one vortex flow generator groove 10 is provided. FIG. 7B shows a case in which two vortex flow generator grooves 10 are point-symmetrically arranged with respect to the center of the nozzle hole 5. FIG. 7C shows a case in which three vortex flow generator grooves 10 are point-symmetrically arranged with respect to the center of the nozzle hole 5. FIG. 7D shows a case in which four vortex flow generator grooves 10 are point-symmetrically arranged with respect to the center of the nozzle hole 5. The greater the number of the passages, the higher the vortex strength.

In this connection, fuel flows in the direction indicated by the arrow. However, in the same manner as that shown in FIGS. 6A to 6E, in any structure shown in FIGS. 7A to 7D, the peripheral portion of the metering plate 3 is located on the right of the drawing. Therefore, the flow from the right is strongest.

Next, referring to FIGS. 8A to 8C, explanations will be made into variations having a function of giving a pre-rotation by which a flow of fuel rotates when the flow of fuel flows into the nozzle hole.

In any case, fuel is made to flow in the tangential direction from the right, on which the peripheral portion of the metering plate 3 is closest, to the circumferential edge of the nozzle hole, and the flow of fuel is strongly curved in a region near the nozzle hole.

Figure 8A:
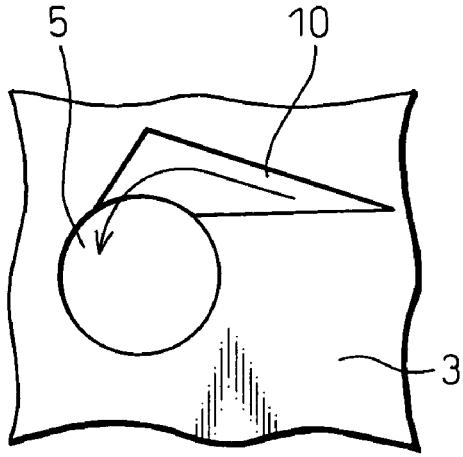
FIG. 8A is a view showing a vortex flow generator groove, the basic shape of which is a triangle, by which a flow of fuel is revolved when it flows into a nozzle hole.
Figure 8B:
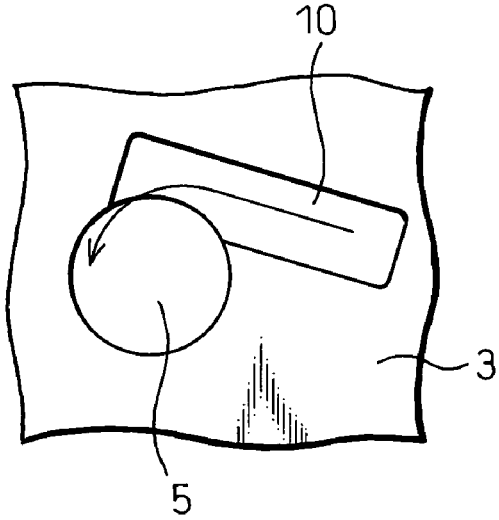
FIG. 8B is a view showing a vortex flow generator groove, the basic shape of which is a rectangle, by which a flow of fuel is revolved when it flows into a nozzle hole.
Figure 8C:
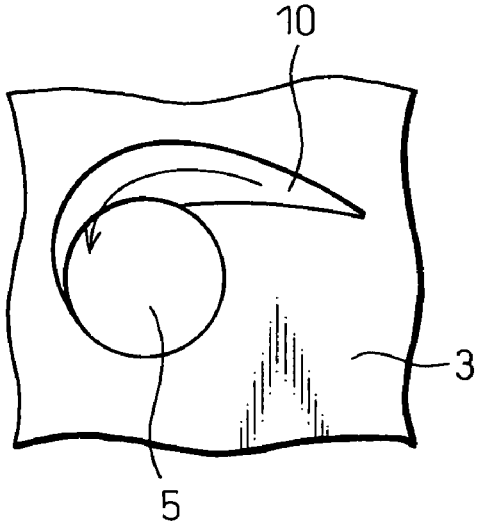
FIG. 8C is a view showing a vortex flow generator groove, the basic shape of which is a crescent, by which a flow of fuel is revolved when it flows into a nozzle hole.

FIG. 8A shows a structure in which the basic shape is a triangle when the view is taken from an upper portion of the groove. In this structure, a pre-rotation is given to a fuel flow a by the apex angle located on the side (in the upper portion in the drawing) of the nozzle hole 5. FIG. 8B shows a case in which the basic shape is a rectangle. In the same manner, a pre-rotation is given to a flow of fuel by the apex angle located on the side (in the upper portion in the drawing) of the nozzle hole 5. FIG. 8C shows a case in which the basic shape is a substantial crescent. In this case, a pre-rotation is given to a flow of fuel by the entire protruding portion.

Due to the above structure, in the case where the peripheral portion of the metering plate 3 is located on the right of the drawing, fuel flows as shown by the arrow in the drawing and a pre-rotation is given in the vortex flow generator groove 10. As a result, a stronger vortex can be obtained.

Next, referring to FIGS. 9A to 9F, explanations will be made into variations of the shape of the nozzle hole 5.

Figure 9A:
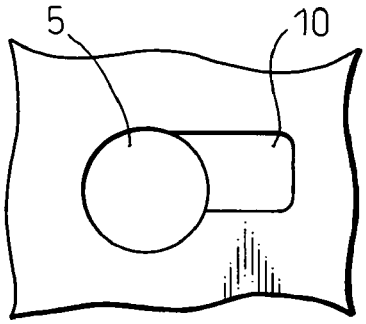
FIG. 9A is a top view of a straight nozzle hole.

FIG. 9A shows the standard shape, that is, FIG. 9A is a top view of the straight nozzle hole 5 which extends straight perpendicularly to the face of the metering plate 3 as shown in FIG. 3A. FIG. 9D is a sectional view of the straight nozzle hole 5.

Figure 9B:
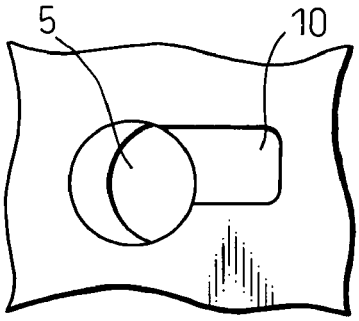
FIG. 9B is a top view of an oblique nozzle hole.

FIG. 9B shows an oblique nozzle hole 5 which obliquely extends with respect to the surface of the metering plate 3. FIG. 9E is the sectional view.

Figure 9C:
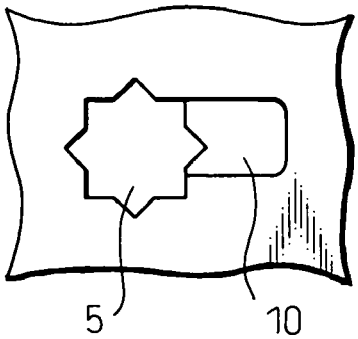
FIG. 9C is a top view of a nozzle hole, the cross section of which is deformed.
Figure 9D:
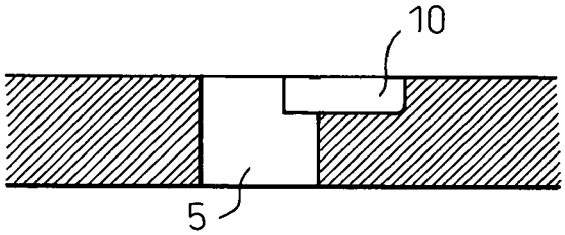
FIG. 9D is a sectional view of a straight nozzle hole.
Figure 9E:
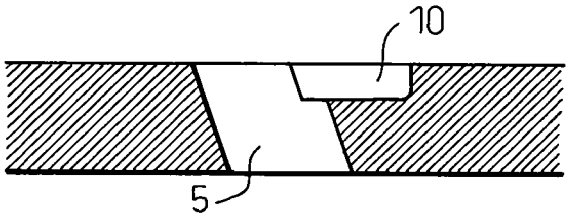
FIG. 9E is a sectional view of an oblique nozzle hole.
Figure 9F:
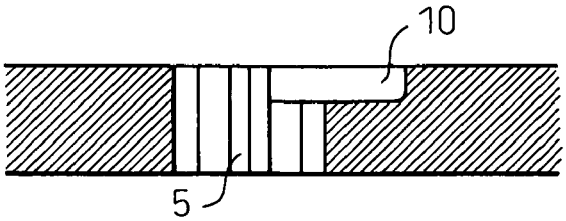
FIG. 9F is a sectional view of a nozzle hole, the cross section of which is deformed.

FIG. 9C shows a deformed nozzle hole 5, the nozzle hole of which is an octagonal star shape.

In this connection, the shape of the nozzle hole 5 is not limited to the above specific embodiments, that is, various shapes can be adopted.

In the first embodiment described above including the variations, fuel is made to be a vortex flow in the nozzle hole 5 by the vortex flow generator groove 10 and injected from an outlet of the nozzle hole 5. The thus injected fuel is diffused into a megaphone-shape and excellently atomized without being formed into a liquid column spray.

Figure 10:
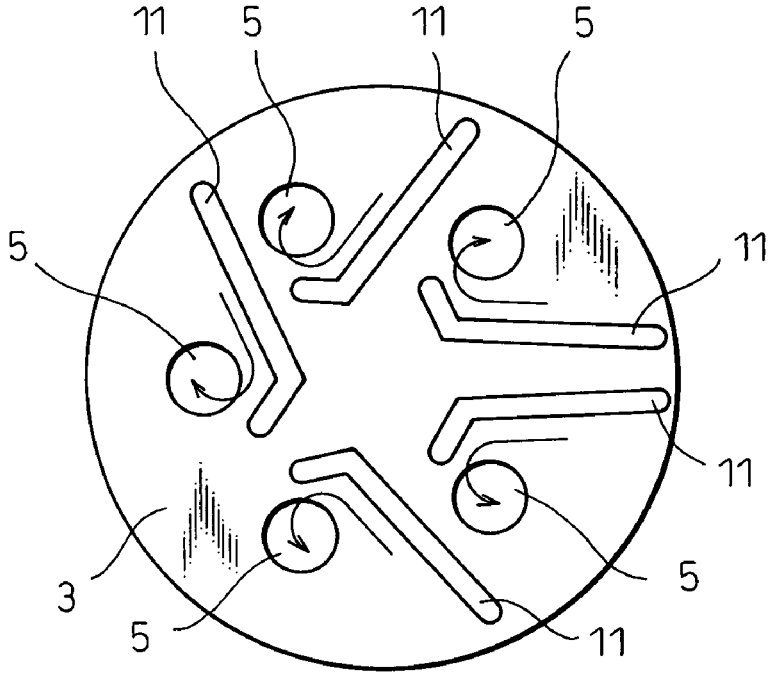
FIG. 10 is a view showing guide protrusions provided on a surface of a metering plate in the second embodiment.

Next, the second embodiment will be explained below. In this second embodiment, the guide protrusions 11, which are formed into a rib-shape and rising upward, are provided on an upper face of the metering plate 3, and fuel is guided into the nozzle holes 5 being rotated by these guide protrusions 11. FIG. 10 is a top view of the metering plate 3 of the second embodiment. In this connection, in the structure shown in FIG. 10, the nozzle holes 5 are arranged round the center of the metering plate 3 being distributed by an unequal angle. Therefore, the guide protrusions 11 of the three nozzle holes 5, which are located on the upper side and the left in the drawing, are arranged clockwise in the drawing. The guide protrusions 11 of the two nozzle holes 5, which are located on the lower side in the drawing, are arranged counterclockwise in the drawing. If the nozzle holes 5 are equally arranged on the metering plate 5, the guide protrusions 11 of the nozzle holes 5 are not necessarily arranged like this. Concerning the shape of the nozzle holes 5, the straight nozzle holes 5 are shown in the drawing, however, as shown in FIG. 9, the deformed nozzle holes 5 may be adopted. In this connection, a protruding distance of each guide protrusion 11 is determined so that the needle 2 can not collide with the guide protrusion 11 when the needle 2 is extremely protruded, however, a grove corresponding to the guide protrusion 11 may be formed on the lower face.

In the second embodiment, fuel flowing from the peripheral side of the metering plate 10 composed as described above is revolved by the guides 11 and introduced into the nozzle holes 5. Therefore, the same effect as that of the first embodiment can be provided.

Figure 11:
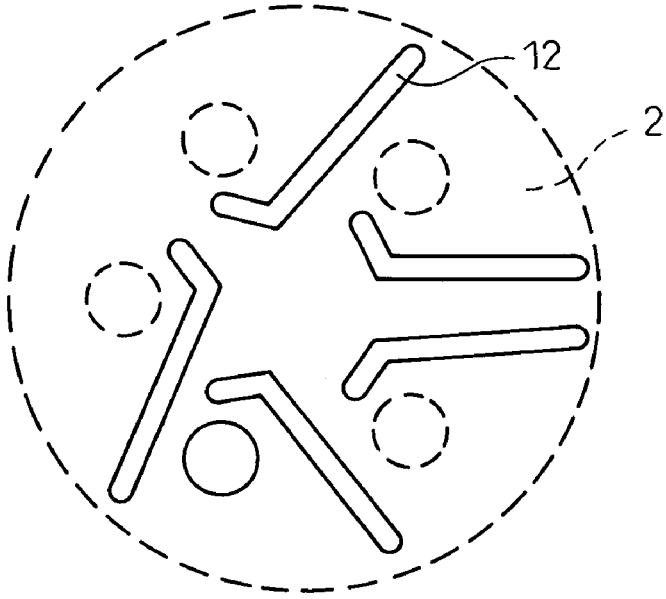
FIG. 11 is a view showing guide protrusions provided on an end face of a needle in the third embodiment.
Figure 12:
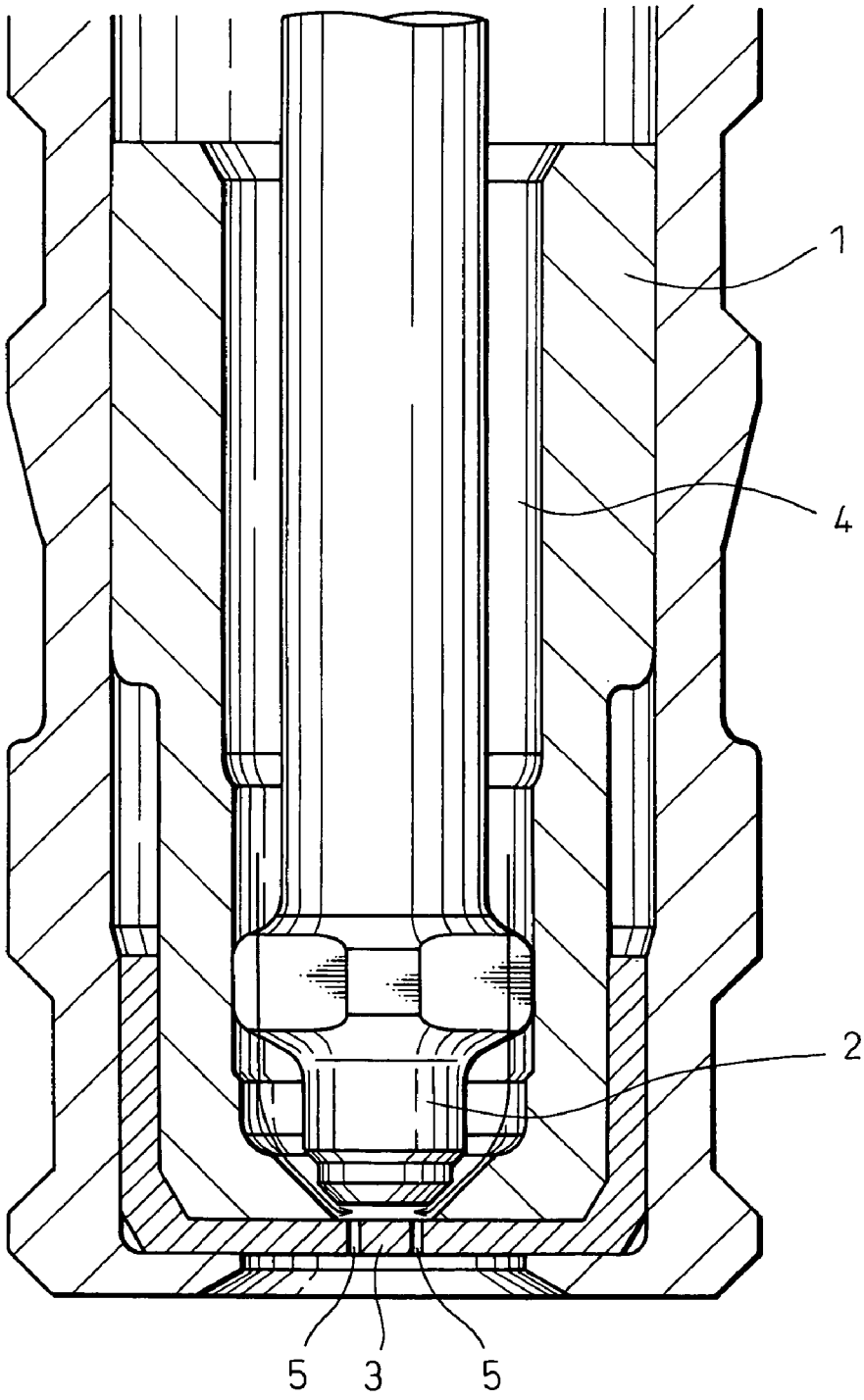
FIG. 12 is a sectional view for explaining a structure of the injection nozzle to which the present invention is applied.
Figure 13:
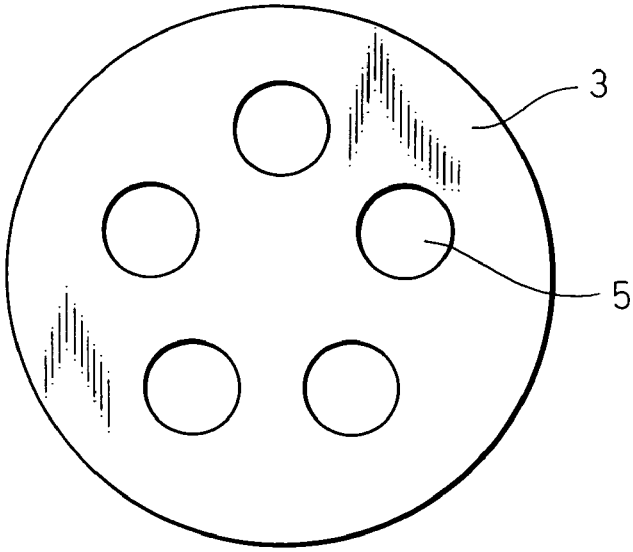
Fig. 13 PRIOR ART
FIG. 13 is a top view of the nozzle hole of the prior art, wherein the view is taken from an upper portion of the plate.
Figure 14A:
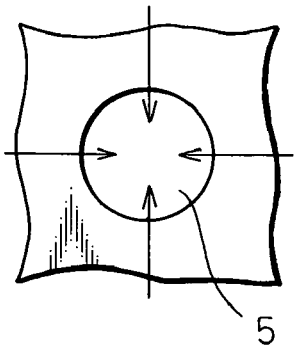
Fig.14A PRIOR ART
FIG. 14A is a top view showing a flow of fuel in the neighborhood of the nozzle hole of the prior art.
Figure 14B:
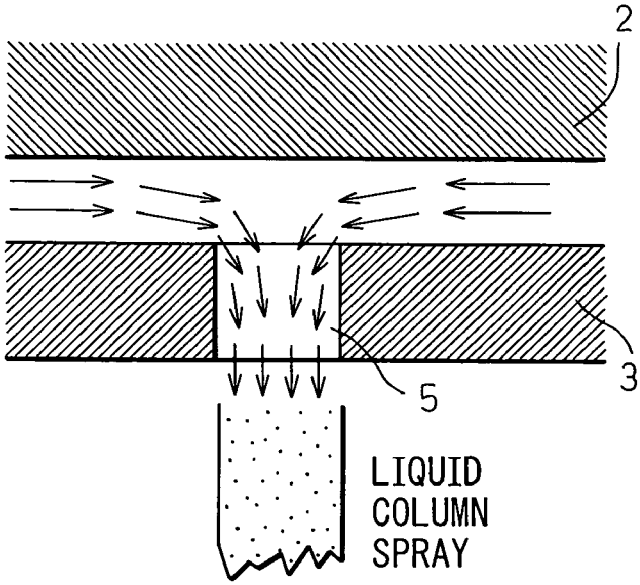
Fig.14B PRIOR ART
FIG. 14B is a sectional view showing a flow of fuel in the neighborhood of the nozzle hole of the prior art.

Next, the third embodiment will be explained below. In this third embodiment, the guide protrusions 12, which are formed into a rib-shape and rising from the lower face, are provided at the forward end portion of the needle 2, and fuel is revolved and introduced into the nozzle holes 5 by these guide protrusions 12. FIG. 11 is a view of the forward end face of the needle 2 of the third embodiment, wherein the view is taken from the metering plate 3 side. In FIG. 11, the broken lines show the effective region of the metering plate 3, on the upper face of which fuel flows, and the positions of the nozzle holes 5. In this connection, in the same manner as that of FIG. 10, in FIG. 11, the nozzle holes 5 are arranged round the center being distributed by an unequal angle. In this connection, in the third embodiment, if the needle 2 is rotated round the axis, it becomes impossible to guide a vortex flow into each nozzle hole 5. Therefore, the needle 2 is fixed by an appropriate method so that it can not be rotated.

In the third embodiment, fuel flowing from the peripheral side of the metering plate 10 composed as described above is revolved by the guide protrusions 12 and introduced into the nozzle holes 5, and the same effect as that of the first embodiment can be provided.

The present invention is applied to a fuel injection valve in which nozzle holes are formed on a metering plate and fuel flowing on a face of the metering plate on the upstream side is injected outside of a face of the metering plate on the downstream side through the nozzle holes. However, it should be noted that the present invention can be applied to other injection valves of the same structure.

The invention claimed is:

1. A fuel injection valve in which a nozzle hole is formed on a metering plate and fuel flowing on a face on the upstream side of the metering plate is injected outside of a face on the downstream side of the metering plate, the fuel injection valve comprising:

a vortex flow generator means for making a flow of fuel passing in the nozzle hole form into a vortex flow, wherein the vortex flow generator means is provided on the upstream side of the metering plate, wherein the vortex flow generator means is a vortex flow generator groove provided on a face on the upstream side of the metering plate so that the vortex flow generator groove can be connected to a wall face of the inlet of the nozzle hole, a main stream of fuel flowing in the groove is directed to a position deviating from a center of the nozzle hole, and the following relations are established, $$L\times\tfrac{1}{5}<F<L\times\tfrac{2}{3}$$

$$D\times\tfrac{1}{2}<N<D\times 3$$

$$D\times\tfrac{1}{5}<H<D\times\tfrac{2}{3}$$

$$D\times\tfrac{1}{5}<B<D\times\tfrac{1}{2},$$

where D is a diameter of the nozzle hole, L is a thickness of the metering plate, F is a depth of the vortex flow generator groove, N is a length of the vortex flow generator groove, H is a width of the vortex flow generator groove, and B is an offset of the center line in the longitudinal direction from the center of the nozzle hole.

2. A fuel injection valve in which a nozzle hole is formed on a metering plate and fuel flowing on a face on the upstream side of the metering plate is injected outside of a face on the downstream side of the metering plate, the fuel injection valve comprising:

a vortex flow generator means for making a flow of fuel passing in the nozzle hole form into a vortex flow, wherein the vortex flow generator means is provided on the upstream side of the metering plate, wherein the vortex flow generator means is a vortex flow generator groove provided on a face on the upstream side of the metering plate so that the vortex flow generator groove is cut into to a wall face of the inlet of the nozzle hole, a main stream of fuel flowing in the groove is directed to a position deviating from a center of the nozzle hole, and a depth of the vortex flow generator groove is formed to be increased or decreased toward the nozzle hole.

3. A fuel injection valve in which a nozzle hole is formed on a metering plate and fuel flowing on a face on the upstream side of the metering plate is injected outside of a face on the downstream side of the metering plate, the fuel injection valve comprising:

a vortex flow generator means for making a flow of fuel passing in the nozzle hole form into a vortex flow, wherein the vortex flow generator means is provided on the upstream side of the metering plate, wherein the vortex flow generator means is a vortex flow generator groove provided on a face on the upstream side of the metering plate so that the vortex flow generator groove is cut into to a wall face of the inlet of the nozzle hole, a main stream of fuel flowing in the groove is directed to a position deviating from a center of the nozzle hole, and the shape of the vortex flow generator groove is a rectangle, a semi-ellipse, a triangle having one vertex on the nozzle hole side, a triangle having one vertex on the end portion side or a comma-shape curved in the direction of revolution of fuel.

* * * * *